US010633179B2

(12) United States Patent
Schoonmaker

(10) Patent No.: US 10,633,179 B2
(45) Date of Patent: Apr. 28, 2020

(54) GARBAGE CAN LID LOCKING DEVICE FOR USE WITH TRUCK HAVING A MECHANICAL ARM

(71) Applicant: Michael C Schoonmaker, Austin, TX (US)

(72) Inventor: Michael C Schoonmaker, Austin, TX (US)

( * ) Notice: Subject to any disclaimer, the term of this patent is extended or adjusted under 35 U.S.C. 154(b) by 145 days.

(21) Appl. No.: 15/848,921

(22) Filed: Dec. 20, 2017

(65) Prior Publication Data

US 2018/0208396 A1 Jul. 26, 2018

Related U.S. Application Data

(60) Provisional application No. 62/449,965, filed on Jan. 24, 2017.

(51) Int. Cl.
*B65F 1/16* (2006.01)
*B65F 1/14* (2006.01)

(52) U.S. Cl.
CPC ..... *B65F 1/1615* (2013.01); *B65F 1/1452* (2013.01)

(58) Field of Classification Search
CPC ..... B65F 1/1615; B65F 1/122; B65F 1/1646; B65F 2210/148; B65F 2001/1669; Y10T 16/5407; Y10S 220/908; Y10S 292/04; B65D 2543/00101; B65D 2543/00277; B65D 2543/00296; B65D 2543/00574
USPC ..... 220/315
See application file for complete search history.

(56) References Cited

U.S. PATENT DOCUMENTS 3,100,580 A * 8/1963 Smith ..... B65F 1/1615 220/817
5,090,753 A * 2/1992 Goodman ..... B65F 1/1615 220/262
5,385,258 A * 1/1995 Sutherlin ..... B65F 1/1615 220/324
5,599,050 A * 2/1997 Tinsley ..... B65F 1/1615 220/908
5,997,052 A * 12/1999 Reeb ..... B65F 1/1615 292/148
2010/0102575 A1* 4/2010 Ferkovich ..... B65F 1/1615 292/259 R
2013/0032597 A1* 2/2013 Anderson ..... B65F 1/1468 220/324
2013/0327775 A1* 12/2013 Diaz ..... B65F 1/122 220/315
2014/0197172 A1* 7/2014 Magny ..... B65F 1/1615 220/318
2014/0208813 A1* 7/2014 Reeb ..... B65F 1/1615 70/277
2014/0224806 A1* 8/2014 Michael ..... E05B 15/0093 220/324
2014/0299602 A1* 10/2014 Manssourian ..... B65F 1/1615 220/315

(Continued)

*Primary Examiner* — Shawn M Braden
(74) *Attorney, Agent, or Firm* — Greg N. Geiser; Gutwein Law

(57) ABSTRACT

A lid retaining device adapted to secure the lid of a container. The device adapted for receipt on the container and for contact with a mechanical arm of a garbage truck, wherein a grasping force applied to the device will move the device from a closed position to an open position. The device having a lid retaining means with an adjustable height, the height adapted to allow the lid be retained at a position that is not completely closed.

9 Claims, 4 Drawing Sheets

(56) References Cited

U.S. PATENT DOCUMENTS

| | | | | |
|---|---|---|---|---|
| 2014/0306465 | A1* | 10/2014 | Kreitzer | E05F 1/002 292/305 |
| 2014/0325805 | A1* | 11/2014 | Troiano | F16B 45/04 24/600.5 |
| 2015/0314957 | A1* | 11/2015 | Reeb | E05B 67/38 220/315 |
| 2016/0159570 | A1* | 6/2016 | Reeb | B65F 1/1615 220/324 |
| 2016/0257491 | A1* | 9/2016 | Manssourian | B65F 1/1615 |
| 2017/0081119 | A1* | 3/2017 | Blazer | B65F 1/1615 |
| 2017/0190509 | A1* | 7/2017 | Reeb | B65F 1/122 |
| 2017/0320665 | A1* | 11/2017 | Reeb | B65F 1/1615 |
| 2017/0320666 | A1* | 11/2017 | Reeb | B65F 1/1615 |
| 2017/0320667 | A1* | 11/2017 | Stone | B65F 1/1615 |

* cited by examiner

GARBAGE CAN LID LOCKING DEVICE FOR USE WITH TRUCK HAVING A MECHANICAL ARM

CROSS REFERENCE TO RELATED APPLICATIONS

This application claims priority to U.S. Provisional Patent Application No. 62/449,965 filed 25 Jan. 2017 to the above named inventor, and is herein incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

The invention relates generally to an improved garbage can lid locking device adapted for use with truck's that collect and empty garbage cans through a mechanically operated arm.

BACKGROUND

Currently and typically, garbage is collected on the roadside through a specialized garbage truck. In a typical trash pickup, the truck will pull alongside and adjacent to a refuse container where a mechanical arm is deployed from the truck to generally grasp the container at a waist portion along its width wherein the container is lifted, tilted, and dumped into the truck for disposal. After emptying, the container is returned to its position and the truck moves along.

A typical container adapted for this mechanism of disposal is generally a specialized container having a hinged lid portion that is adapted for easy opening and closing. Accordingly, the hinged connection allows the lid to swing open upon inversion of the container for dumping. Consequently, this hinged connection, does not generally provide a secure closure, wherein the contents of the container can be easily accessed by unwanted intruders, such as pests, or subjected to unwanted dumping and opening.

Within the art, there presently exist devices disclosing locking elements adapted to secure the hinged lid of a refuse container. U.S. Pat. No. 6,290,093 discloses a locking device for a container lid that is generally adapted for opening selectively through a lug and key mechanism and when the container is tilted to a position beyond 90 degrees. This '093 mechanism is placed within the lid and adapted for embedding into the lid during manufacturing and assembly, only capable of being locked when the lid is in a completely closed position, and can be inadvertently opened when the container falls over.

Further, U.S. Pat. No. 5,738,395 discloses a self-releasing latch that is generally unlatched when the device is tipped. The '395 device generally comprises a keeper member that is attached adjacent to a front of the container and aligned with a heavy latching member that is swingably suspended from the lid directly above the keeper. This '395 mechanism is disclosed as being affixed in a semi-permanent assembly through fasteners, only capable of being locked and operable when the lid is in a completely closed position, and can be inadvertently opened when the container falls over.

Due to the limitations of the devices within the prior art, there is a need in the marketplace for garbage can locking device that is adapted for use on containers intended to be emptied through a mechanical arm and unlocking through the grasping of the mechanical arm. In particular the device is adapted for attachment to an existing garbage container in a non-obtrusive manner and allows for securing the lid in a position that is not completely closed.

SUMMARY OF THE INVENTION

The included disclosure relates generally to an improved garbage container locking assembly that is adapted for opening through grasping by the mechanical arm of a garbage truck. Accordingly, the disclosed device is adapted for affixing to the side of a container and adapted for movement from a locked position to an unlocked position upon grasping by the mechanical arm.

The device is adapted for placement on a side portion of a garbage container to generally provide a means to secure a lid of the container from opening. In particular, the device is adapted for movement from a locked and closed position to an open position by the mechanical arm of a garbage truck.

The device is generally comprised of an assembly of a mounting bracket, an upper arm assembly, and a lower arm assembly. The device is generally and preferably provided in a pair of devices received on opposed sides of the container and operating in a cooperation to the seal the container lid in a fixed position to prevent unwanted opening.

The mounting bracket includes a first side comprising a generally flat surface adapted for affixing to the side of the container in a manner that does not require modification of the container. Preferably, the bracket first side is secured to the side of the container though an adhesive member, such as double sided adhesive pad having an industrial grade adhesive. This adhesive pad can be preinstalled onto the bracket first side or provided as a stand-alone member to be affixed by a user. Alternately, other fastening means that do not damage or require modification of the container can be utilized.

The mounting bracket includes a second side on an opposed side of the first side including a bracket. The bracket providing a fixed point for the hinged attachment of the upper arm assembly. The second side adapted to receive a cover. The cover generally protecting the assembly within an interior portion of the cover.

The upper arm assembly in a hinged coupling with the bracket and in a hinged coupling with the lower arm assembly to allow for an articulation of the device. The upper arm assembly most generally providing a movable securing means for securing the lid of the container in a closed position. The upper arm assembly including a retaining member. The retaining member extending perpendicular to a length of the device and towards an interior position of the container. Accordingly, the retaining member is positioned to extend over and above the lid of the container to prevent the lid from opening and to retain the lid in a generally fixed position. Preferably, the retaining member is adjustable in height defined as a direction extending opposite the lower arm assembly. This adjustability of the height of the retaining member allows the lid to be retained in a position even when the lid is not completely closed, wherein the container may be stuffed of refuse and the lid not capable of a complete closure.

Preferably, the retaining member is received at an end of a shaft, wherein the shaft has an end opposed the retaining member that is slidably received within a sleeve. The sleeve generally having a cavity to receive the shaft and including a ratcheting means to engage corresponding teeth along a height of the shaft, wherein the shaft is selectively movable to a desired height where it can be retained and secured in that position through the ratcheting means and teeth engagement. Accordingly, the retaining member adjustable height can be maintained in a fixed position.

The upper arm assembly hinged coupling includes a tab received within the bracket, wherein the upper arm assembly is movable in an arc along a height of the container. Preferably, the tab is positioned on a connecting portion of the upper arm assembly extending perpendicular to the length of the upper arm assembly in towards the container, wherein the tab and retaining member extend in similar directions towards the interior of the container.

The upper arm assembly including a lower hinged connection coupled with a corresponding upper hinged connection on a first end of the lower arm assembly. The lower hinged connection positioned below the tab, wherein the upper arm assembly has a pair of pivot points with a first pivot point at a connection between the tab and the bracket and a second pivot point at a connection between the lower hinged connection and upper hinged connection. Accordingly, movement of the lower arm assembly in a first direction will effectuate a corresponding movement of the upper arm assembly in a second direction opposite the first direction.

The coupling of the lower hinged connection and upper hinged connection supported though a compliant member. The compliant member generally received on an upper portion of the lower arm assembly and a lower portion of the upper arm assembly extending over the hinged coupling of the lower connection and upper connection to support the connection and effectuate the desired movement of the device.

The lower arm assembly is adapted for positioning under the upper arm assembly and extending from the hinged connection towards a lower portion of the container. The lower arm assembly having a length extending from the hinged connection to a lower portion opposite the hinged connection. The lower arm assembly having an arcuate shape with a bowed portion of the lower arm assembly extending outward from the container opposite the bracket.

The bowed portion of the lower arm assembly adapted for contact by the mechanical arm of the garbage truck, wherein the arm of the truck provides a grasping force to the bowed portion to generally move the lower arm assembly towards the container in the first direction. This movement of the lower arm assembly is translated to an opposed movement in the second direction of the upper arm assembly away from the container, wherein the retaining member is moved away from the lid to allow the lid to be free of restriction from opening. Accordingly, the container can be unlocked upon grasping and emptied.

For proper use by a user, the device is generally adapted for placement on the container, wherein the upper arm assembly retaining member is aligned for selective retaining of the container lid. During use, a user is free to adjust the height of the retaining member to retain the lid in a closed or partially closed position. To lock and unlock the container, the user can selectively move the upper arm assembly retaining member over the lid or away from the lid. During pickup, the device can remain in the locked position and moved to an open position through a movement of the lower arm assembly by the mechanical grasping arm of the truck for collection.

BRIEF DESCRIPTION OF THE DRAWINGS

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein.

DETAILED DESCRIPTION OF THE INVENTION

Figure 1:
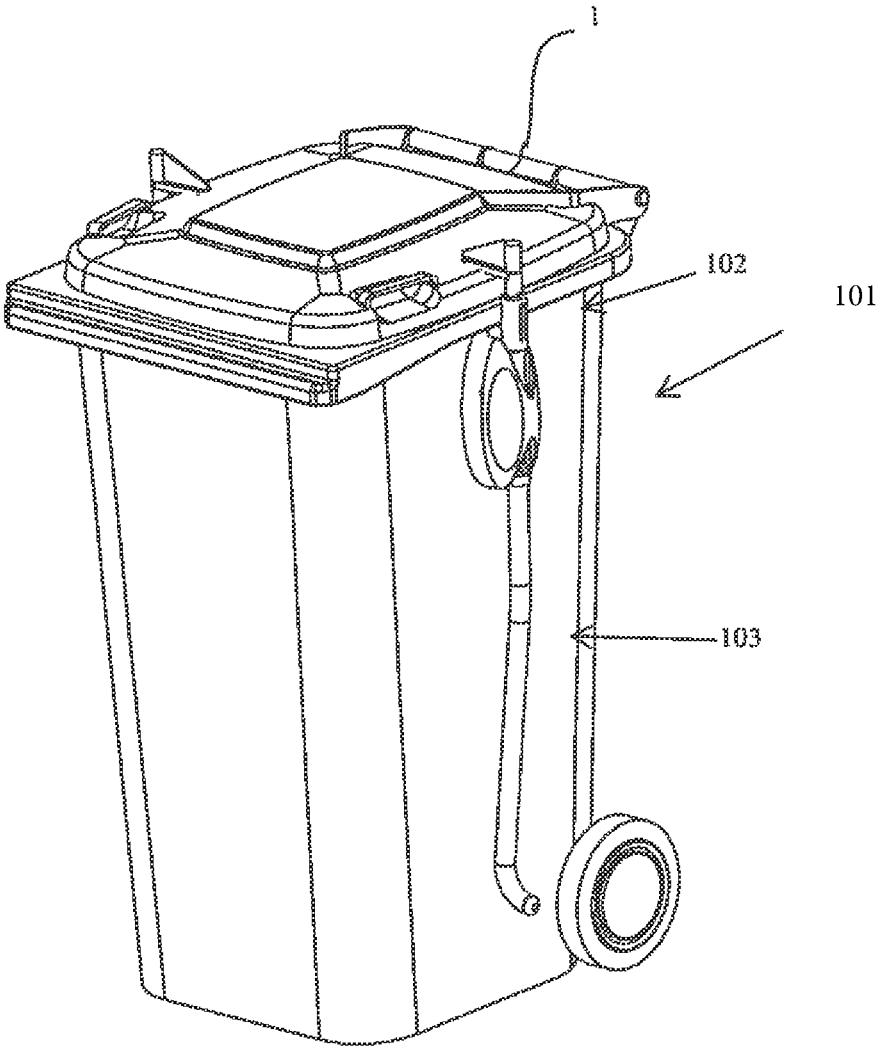
FIG. 1 shows an isometric view of the device installed on a container, according to the present disclosure.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful, and is not intended to exclude other embodiments from the scope of the invention.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Figure 2:
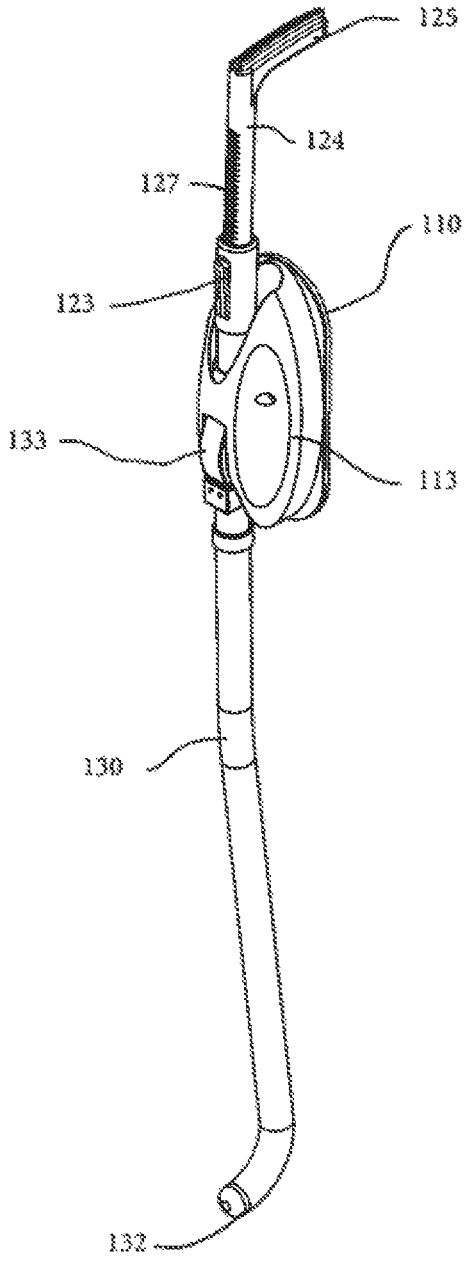
FIG. 2 shows an isometric view of the device, according to the present disclosure.
Figure 3:
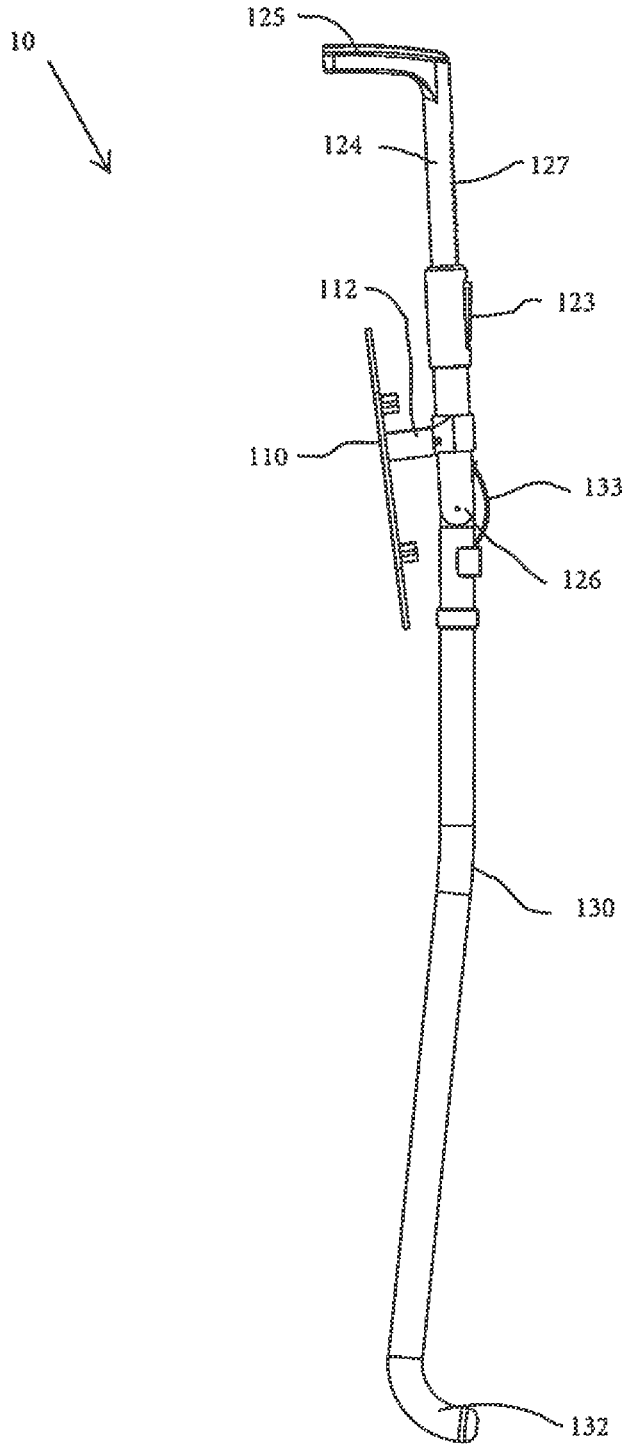
FIG. 3 shows a side view of the device with the cover removed, according to the present disclosure.
Figure 4:
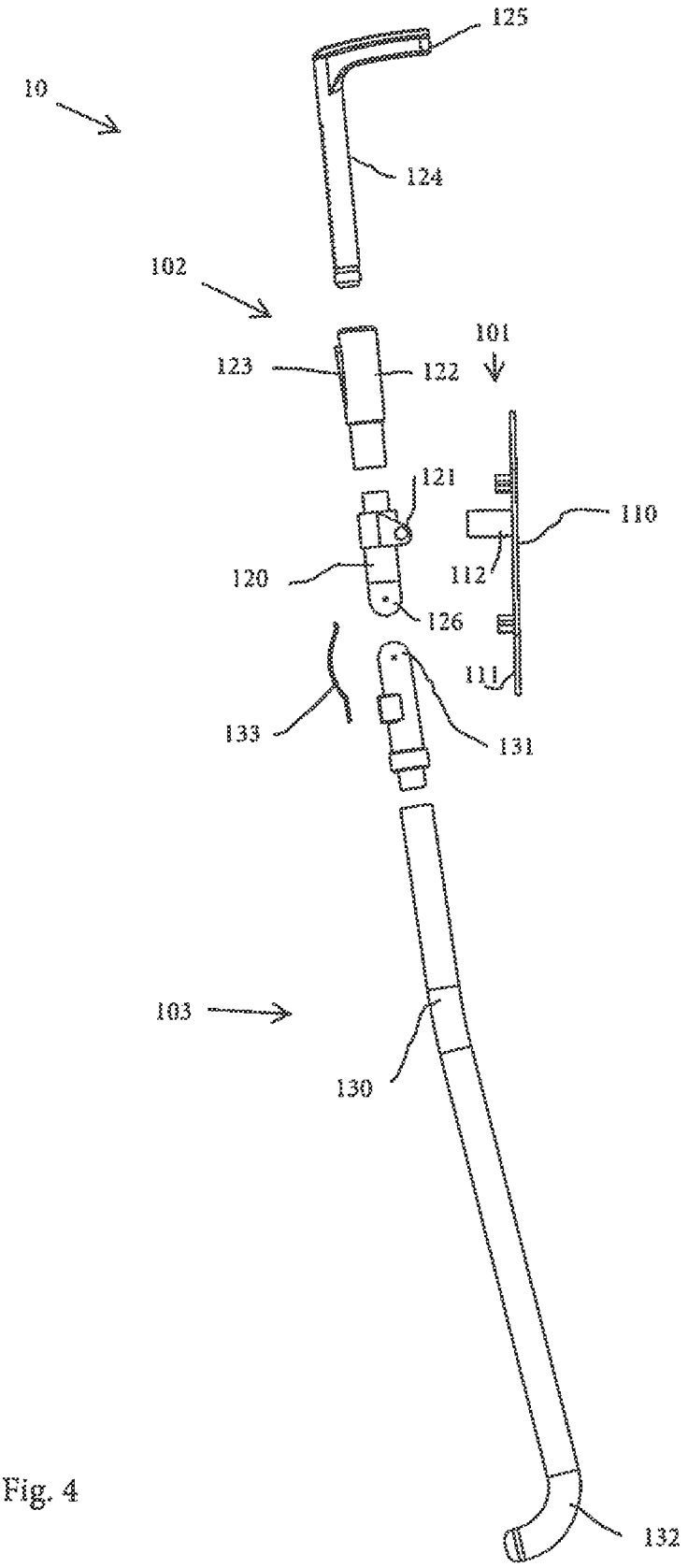
FIG. 4 shows an exploded side view of the device with the cover removed, according to the present disclosure.

Referring to the figures, FIGS. 1-4 show a garbage can lid locking device of the present disclosure and generally referred to as device 10. The device 10 is adapted for placement on a side portion of a garbage container 1 to generally provide a means to secure a lid of the container 1 from opening. In particular, the device 10 is adapted for movement from a closed position to an open position by a mechanical arm of a garbage truck.

The device 10 is generally comprised of an assembly of a mounting bracket 101, an upper arm assembly 102, and a lower arm assembly 103. The device 10 is generally and preferably provided in a pair of devices 10 received on opposed sides of the container 1 and operating in cooperation to the seal the container 1 lid in a fixed position to prevent unwanted opening.

The mounting bracket 101 includes a first side 110 comprising a generally flat surface adapted for affixing to the side of the container 1 in a manner that does not require modification of the container. Preferably, the bracket 101 first side 110 is secured to the side of the container 1 though an adhesive member, such as double sided adhesive pad having an industrial grade adhesive. This adhesive pad can be preinstalled onto the bracket 101 first side 110 or provided as a stand-alone member to be affixed by a user.

The mounting bracket 101 includes a second side 111 positioned on an opposed side of the first side 110. The second side 111 including a bracket 112. The bracket 112 generally provided from a pair of arms spaced a width and extending perpendicular from a height of the container 1. The bracket 112 generally providing a fixed point for the hinged attachment of the upper arm assembly 102. The second side 111 further adapted to receive a cover 113. The cover 113 generally protecting the assembly within an interior portion of the cover 113.

The upper arm assembly 102 is generally in a hinged coupling with the bracket 112 and in a hinged coupling with the lower arm assembly 103 to allow for an articulation of the device 10. The upper arm assembly 102 most generally providing a movable securing means for securing the lid of the container 1 in a closed position. The upper arm assembly 102 including a retaining member 125. The retaining member 125 extending perpendicular to a length of the device 10 and towards an interior position of the container 1. Accordingly, the retaining member 125 is positioned to extend over and above the lid of the container 1 to prevent the lid from opening and retain the lid in a generally fixed position. Preferably, the retaining member 125 is adjustable in height defined as a direction extending opposite the lower arm assembly 103. This adjustability of the height of the retaining member 125 allows the lid to be retained in a position even when the lid is not completely closed, wherein the container 1 may be stuffed of refuse and the lid not capable of a complete closure.

Preferably, the retaining member 125 is received at an end of a shaft 124, wherein the shaft 124 has an end opposed the retaining member 125 that is slidably received within a sleeve 122. The sleeve 122 generally having a cavity to receive the shaft 124 and including a ratcheting means 123 to engage corresponding teeth 127 along a height of the shaft 124, wherein the shaft 124 is selectively movable to a desired height where it can be retained and secured in that position through the ratcheting means 123 and teeth 127 engagement. Accordingly, the retaining member 125 adjustable height can be maintained in a fixed position.

The upper arm assembly 102 hinged coupling includes a tab 121 received within the bracket 112, wherein the arm assembly 102 is movable in an arc along a length of the container. Preferably, the tab 121 is positioned on a connecting portion 120 of the upper arm assembly 102 extending perpendicular to the length of the upper arm assembly 102 in towards the container, wherein the tab 121 and retaining member 125 extend in similar directions.

The upper arm assembly 102 including a lower hinged connection 126 coupled with a corresponding upper hinged connection 131 on a first end of the lower arm assembly 103. The lower hinged connection 126 positioned below the tab 121, wherein the upper arm assembly 102 has a pair of pivot points with a first pivot point at a connection between the tab 121 and the bracket 112 and a second pivot point at a connection between the lower hinged connection 126 and upper hinged connection 131. Accordingly, movement of the lower arm assembly 103 in a first direction will effectuate a corresponding movement of the upper arm assembly 102 in a second direction opposite the first direction.

The coupling of the lower hinged connection 126 and upper hinged connection 131 is supported though a compliant member 133. The compliant member 133 generally received on an upper portion of the lower arm assembly 103 and a lower portion of the upper arm assembly 102 extending over the hinged coupling of the lower connection 126 and upper connection 131 to support the connection and effectuate the desired movement of the device 10.

The lower arm assembly 103 is adapted for positioning under the upper arm assembly 102 and extending from the hinged connection 131 towards a lower portion of the container 1. The lower arm assembly 103 having a length extending from the hinged connection 131 to a lower portion 132 opposite the hinged connection 131. The lower arm assembly 103 having an arcuate shape with a bowed portion 130 of the lower arm assembly 103 extending outward from the container 1 opposite the bracket 101.

The bowed portion 130 of the lower arm assembly 103 adapted for contact by the mechanical arm of the garbage truck, wherein the arm of the truck provides a grasping force to the bowed portion 130 to generally move the lower arm assembly 103 towards the container 1. This movement of the lower arm assembly 103 is translated to an opposed movement of the upper arm assembly 102 away from the container, wherein the retaining member 125 is moved away from the lid to allow the lid to be free of restriction from opening. Accordingly, the container 1 can be unlocked upon grasping and emptied.

For proper use by a user, the device 10 is generally adapted for placement on the container 1 by affixing and securing the mounting bracket 101 at a side of the container 1 near a top side adjacent an opening of the container 1, wherein the upper arm assembly 102 retaining member 125 is aligned for selective retaining of the container 1 lid. During use, a user is free to adjust the height of the retaining member 125 to retain the lid in a closed or partially closed position. To lock and unlock the container 1, the user can selectively move the upper arm assembly 102 retaining member 125 over the lid or away from the lid. During pickup, the device 10 can remain in the locked position and moved to an open position through a movement of the lower arm assembly 103 by the mechanical grasping arm of a truck for collection.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A container lid retaining device, the device adapted for placement on the container, the device comprising:

a mounting bracket, the mounting bracket affixed to a side of the container;

an upper arm assembly, the upper arm assembly hingedly received on the mounting bracket and movable in an arc along a height of the container, the upper assembly including:

a retaining member, the retaining member positioned at a first end of the upper arm assembly extending perpendicular to a length of the device and towards an interior of the container; and a lower hinged connection, the lower hinged connection at a second end of the upper arm assembly opposed the retaining member, the lower hinged assembly positioned below the hinged receipt on the mounting bracket; and a lower arm assembly, the lower arm assembly including:

an upper hinged connection, the upper hinged connection positioned at a first end of the lower arm assembly, the upper hinged connection coupled to the lower hinged connection;

a second end, the second end opposed the upper hinged connection and defining a length of the lower arm assembly between the upper hinged connection and the second end; and a bowed portion, the bowed portion along the length of the lower arm assembly and extending outward opposite the container, wherein movement of the lower arm assembly in a first direction effectuates a corresponding movement of the upper arm assembly in a second direction opposed to the first direction.

2. A device as in claim 1, wherein the retaining member is adjustable a height opposed the lower arm assembly.

3. A device as in claim 2, wherein the retaining member is received on a shaft, the shaft having a plurality of teeth, the teeth adapted for ratcheting engagement within a sleeve.

4. A device as in claim 1, wherein the hinged coupling of the upper arm assembly and the lower arm assembly includes a compliant member.

5. A device as in claim 1, wherein the mounting bracket is affixed on the container through an adhesive member.

6. A device adapted to selectively secure the lid of a container, the device movable from a closed position to an open position upon grasping in a first direction by a mechanical arm of a garbage truck, the device comprising:

a mounting bracket, the mounting bracket including:

a first side, the first side including a generally flattened surface, the first side affixed to a side of the container; and a second side, the second side opposed the first side, the second side including a bracket;

an upper arm assembly coupled to the mounting bracket, the upper arm assembly including:

a tab, the tab hingedly received on the bracket of the mounting bracket and movable in an arch along a height of the container;

a retaining member, the retaining member positioned at a first end of the upper arm assembly extending perpendicular to a length of the device and towards an interior of the container, the retaining member adjustable a height; and a lower hinged connection, the lower hinged connection at a second end of the upper arm assembly opposed the retaining member, the lower hinged assembly positioned below the hinged receipt of the tab on the bracket; and a lower arm assembly coupled to the upper arm assembly, the lower arm assembly including:

an upper hinged connection, the upper hinged connection positioned at a first end of the lower arm assembly, the upper hinged connection coupled to the lower hinged connection;

a second end, the second end opposed the upper hinged connection and defining a length of the lower arm assembly between the upper hinged connection and the second end; and a bowed portion, the bowed portion along the length of the lower arm assembly and extending outward opposite the container and adapted for contact with the mechanical arm, wherein movement of the lower arm assembly in the first direction effectuates a corresponding movement of the upper arm assembly in a second direction opposite to the first direction.

7. A device as in claim 6, wherein the retaining member is received on a shaft, the shaft having a plurality of teeth, the teeth adapted for ratcheting engagement within a sleeve.

8. A device as in claim 6, wherein the hinged coupling of the upper arm assembly and the lower arm assembly includes a compliant member.

9. A device as in claim 6, wherein the mounting bracket is affixed on the container through an adhesive member.

* * * * *